United States Patent [19]

Pearce

[11] 4,437,810

[45] Mar. 20, 1984

[54] COOLED VANE FOR A GAS TURBINE ENGINE

[75] Inventor: Eric W. J. Pearce, Derby, England

[73] Assignee: Rolls-Royce Limited, London, England

[21] Appl. No.: 351,616

[22] Filed: Feb. 24, 1982

[30] Foreign Application Priority Data

Apr. 24, 1981 [GB] United Kingdom ..... 8112806

[51] Int. Cl.[3] ..... F01D 5/18

[52] U.S. Cl. ..... 415/115; 416/96 A; 416/97 R

[58] Field of Search ..... 415/115; 416/96 A, 97, 416/97 A, 233, 90

[56] References Cited

U.S. PATENT DOCUMENTS

| | | | |
|---|---|---|---|
| 3,767,322 | 10/1973 | Durgin et al. | 416/97 R |
| 4,025,226 | 5/1977 | Hovan | 416/97 A |
| 4,056,332 | 11/1977 | Meloni | 415/115 X |
| 4,252,501 | 2/1981 | Peill | 416/96 A |
| 4,257,734 | 3/1981 | Guy et al. | 416/96 A X |

FOREIGN PATENT DOCUMENTS

| | | |
|---|---|---|
| 666536 | 2/1952 | United Kingdom . |
| 1197232 | 7/1970 | United Kingdom . |
| 1525027 | 9/1978 | United Kingdom . |

*Primary Examiner*—Philip R. Coe
*Assistant Examiner*—Frankie L. Stinson
*Attorney, Agent, or Firm*—Cushman, Darby & Cushman

[57] ABSTRACT

A cooled vane for a gas turbine engine has a hollow aerofoil with apertures at its trailing edge for cooling air ejection. In order to control the flow of cooling air out of these apertures a metering insert extends between the opposed internal faces of the aerofoil adjacent the trailing edge and accurately defines the required flow areas.

In a preferred embodiment the insert is of 'hairpin' cross section and defines the flow area as channels between projections from the limbs of the 'hairpin' which abut with the internal faces of the aerofoil. A cooling air entry tube then engages with the concavity of the hairpin, and the flow down the two flanks of the tube may be controlled by the flow area provided by the projections on the respective limb.

3 Claims, 4 Drawing Figures

COOLED VANE FOR A GAS TURBINE ENGINE

This invention relates to a cooled vane for a gas turbine engine.

It is usual for such vanes to have aerofoil portions which are hollow and provided with apertures at or adjacent the trailing edge through which cooling air may leave the hollow interior. Often the vane aerofoil is also provided with an air entry or impingement tube mounted within the hollow interior. The cooling air enters the tube, flows through small apertures in the tube in the form of jets which impinge on the inner surface of the aerofoil, and leaves the aerofoil through the trailing edge apertures.

In both these cases it is desirable but difficult to meter the airflow leaving the vane through the trailing edge apertures. Thus this can be used simply to meter the airflow through the vane, or it can be used to deter leakage of the incoming air directly into the space between the tube and the blade interior. The difficulty of metering the air arises because the very small passages needed would be difficult to drill or otherwise form in the trailing edge region.

The present invention provides a construction which enables the airflow to be metered using an insert which can provide accurate metering.

According to the present invention a cooled vane for a gas turbine engine comprises a hollow aerofoil having an aperture or apertures in the trailing edge region, the aperture or apertures communicating with the hollow interior of the vane for the flow therethrough of cooling air, and a flow metering insert which extends between the opposed faces of the hollow interior of the vane adjacent the trailing edge and provides an accurately predetermined flow area for cooling fluid leaving the hollow interior via the aperture or apertures in the trailing edge region.

The flow metering insert may be provided with projections which cooperate with the interior surface of the vane to define said flow area.

In a preferred embodiment a cooling air entry tube is located within the hollow interior of the vane, and the trailing edge region of the tube seals with said insert. Thus the insert may be of 'hairpin' section, the trailing edge of the tube projecting within the concave part of the section to the insert.

Figure 1:
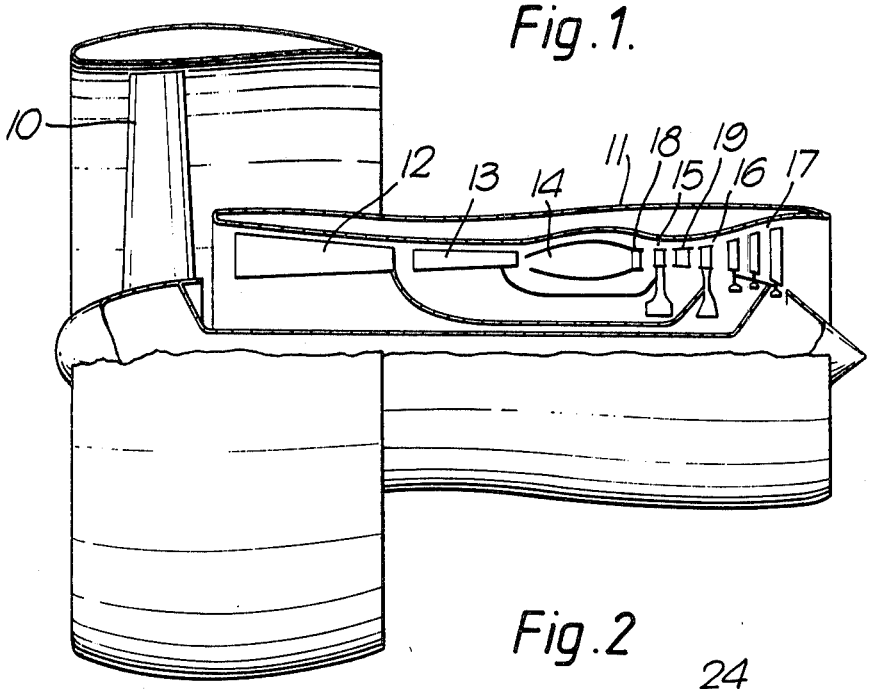
Figure 2:
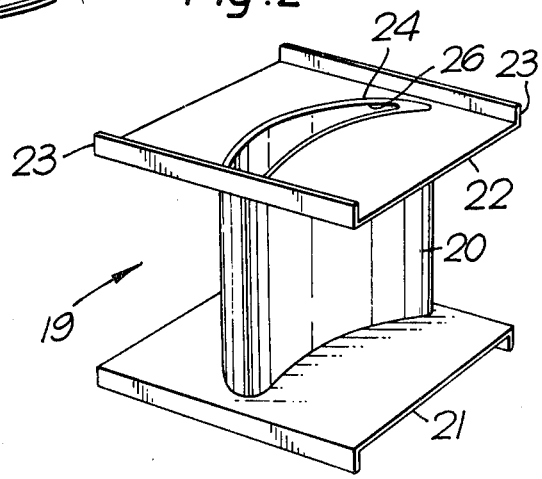
Figure 4:
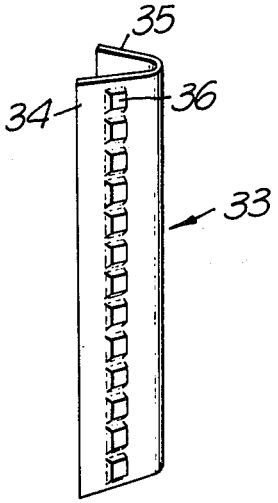
Figure 3:
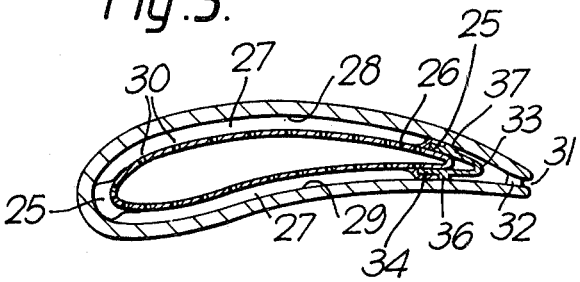

The invention will now be particularly described, merely by way of example, with reference to the accompanying drawings in which:

FIG. 1 is a partly broken-away view of a gas turbine engine having cooled vanes in accordance with the present invention, FIG. 2 is an enlarged perspective view of one of the vanes of FIG. 1, FIG. 3 is a further enlarged section through the aerofoil of the FIG. 2 vane, and FIG. 4 is a perspective view of the metering insert visible in FIG. 3.

In FIG. 1 there is shown a gas turbine engine comprising a fan 10 driven by a core engine 11. The core engine comprises intermediate pressure and high pressure compressors 12 and 13, a combustion system 14, and high, intermediate and low pressure turbines 15, 16 and 17 all in flow series. The intermediate and high pressure compressors are drivingly interconnected with their respective turbines and are driven thereby while the low pressure turine drives the fan. The overall operation of the engine is generally well known in the art, and will not be further described herein.

It will be understood that each of the turbines consist of one or more stages of rotor blades onto each stage of which the hot gas flow of the engine is directed by a corresponding stage of static vanes known as nozzle guide vanes. The vanes 18 and 19 of the high and intermediate pressure turbines respectively of the engine of FIG. 1 are cooled by the flow of cooling air through their hollow interiors which are configured to different degrees of complexity. In the present case, the invention is applied to the vanes 19, one of which is shown in an enlarged perspective view of FIG. 2.

The vane 19 will be seen to comprises a hollow aerofoil 20 mounted between inner the outer segmented platforms 21 and 22. The platforms are provided with mounting flanges 23 by which the vane is supported from fixed structure of the engine, and in the upper surface of the platform 22 is visible the aperture 24 at the extremity of the hollow interior 25 of the aerofoil 20 and the end of the cooling air entry tube or impingement tube 26 which fits closely into the aperture 24 and extends within the cavity 25.

Operation of the cooling system of the vane may be understood more easily by reference to FIG. 3 which shows the vane aerofoil in further enlarged transverse section. It will be seen that the tube 26 is held by ribs 27 within the hollow interior 25 of the aerofoil so that the wall of the tube is maintained at a substantially constant spacing from the inner surface of the aerofoil. It is convenient to look upon this surface as comprising two opposing surfaces 28 and 29 forming the interior of the convex and concave flanks of the aerofoil respectively.

The tube 26 is provided with small apertures 30 distributed over its area, and the cooling air is arranged to enter the tube and to flow through the apertures 30 in the form of a plurality of jets of air. These jets impinge on the inner surfaces of the vane, cooling these surfaces and thus the outer surface of the vane aerofoil. The air which has impinged on the interior surfaces flows in the clearance between the tube and the vane in a rearward direction to leave the vane through a plurality of apertures 31 formed in the trailing edge of the aerofoil. It will be noted that struts 32 inter-connect the opposed flanks of the trailing edge portion of the vane aerofoil so as to strengthen it. The struts 32 divide the apertures 31 one from another, but it will be understood that the apertures 31 could be regarded as parts of a single slot and that they could be replaced by more clearly separate apertures such as drillings. The apertures could also be positioned slightly away from the extreme region of the trailing edge.

The cooling air which feeds the cooling system of the vane enters the vane through the aperture 24 and is intended to flow entirely into the tube 26. Unfortunately it is very difficult to seal adequately between the tube end and the aperture, and since the apertures 31 do not form any restriction to the flow, there would be a tendency for the air to leak between the tube end and the blade and to flow directly through the apertures 31. This air would bypass the tube 26 and would not take part in the impingement cooling process, thus representing an inefficient use of some cooling air.

In the vane of the present invention therefore, a flow metering insert 33 is provided in the hollow interior of the vane. FIG. 4 shows the shape of this insert in perspective, while FIG. 3 illustrates where the insert is positioned in the aerofoil. It will be seen that the insert comprises basically a metal sheet folded in half so that it has a hairpin-shaped cross section. On each of the outer surfaces of the limbs 34 and 35 of the section is formed a row of projections 36 and 37 respectively. As can be seen in FIG. 3, these projections abut with the surfaces 29 and 28 respectively and define channels between the projections whose dimensions can be accurately formed. The length of the insert is such as to extend from end-to-end of the cavity 25. Preferably the insert is sufficiently resilient for the limbs when in position to provide a spring loading pushing the projections against the surfaces.

The insert therefore provides a construction which enables the total flow through the trailing edge apertures 31 to be metered by the area of the channels formed between the projections and the inner aerofoil surfaces. The insert could thus be used in a vane not having an air entry tube, but in the illustrated embodiment the tube cooperates with the insert in such a way as to allow the flows from each flank of the tube to be metered separately.

As can be seen in FIG. 3, the trailing edge portion of the tube 26 is arranged to fit within the hollow of the hairpin section insert 33, and the dimensions of the pieces are arranged so that the tube and insert sealingly engage. This is aided by the resilience of the limbs of the insert which will allow small inaccuracies to be tolerated. The effect of this is to allow the gap between the tube and the aerofoil on one flank to be separated from that on the other. By arranging that the gaps between the projections on one limb of the insert differ from those on the other limb, the flow rates from the two flanks of the tube may be arranged to differ as required.

One further point to be noted in connection with the insert 33 is that the limbs 34 and 35 are of unequal length. They are in fact arranged to fit, with a small clearance, behind the ends of the ribs 27, and since these ribs end at different points on the two flanks of the blade this provides a safety feature which allows the insert only to be assembled into the vane in its correct orientation.

In the embodiment described, the insert is made as a metal sheet with ribs thereon which are grooved across to provide the discrete projections and hence the metering channels. It will be seen, however, that the projections could be made by other methods; for instance a sheet could have them embossed or otherwise formed on its surface.

Again, although described in relation to the intermediate pressure vanes of a fan engine, the invention is clearly applicable to other vanes and other engines.

I claim:

1. A cooled vane for a gas turbine engine comprising a hollow aerofoil having a leading edge region and a trailing edge region, said aerofoil including convex and concave flanks having opposed faces defining a hollow interior, at least one cooling fluid entry tube extending spandwise of and located within said hollow interior of said aerofoil, said tube being spaced from the opposed faces of said convex and concave flanks to define a clearance therebetween, said tube having apertures for supplying a cooling fluid into said clearance to impinge upon and cool said opposed faces of said convex and concave flanks, an unrestricted aperture means in the trailing edge region of said aerofoil having communication with said clearance for discharging cooling fluid, and a flow metering insert extending spanwise of said aerofoil between opposed faces of said concave and convex flanks of said aerofoil adjacent the trailing edge region thereof for metering the cooling air from said clearance to said unrestricted aperture means, said flow metering insert having a hairpin-shaped cross section defined by a pair of limbs and into which a trailing edge of said tube projects to form a seal therewith, said limbs of said flow metering insert defining two accurately predetermined flow areas for cooling fluid leaving said clearance to be discharged through said unrestricted aperture means, a first one of said flow areas controlling leaving of said fluid from said clearance between said cooling tube and one of said opposed faces and a second one of said flow areas controlling leaving of said fluid from said clearance between said cooling tube and a second one of said opposed faces of said convex and concave flanks of said aerofoil.

2. A cooled vane as claimed in claim 1 and in which said insert is resilient and resiliently presses its limbs against the opposed faces of the hollow vane interior.

3. A cooled vane as claimed in claim 1 in which each of said limbs of said flow metering insert has projections thereon cooperating with the respective opposed faces of said convex and concave flanks of said hollow aerofoil to define said first flow area and said second flow area respectively.

* * * * *